United States Patent [19]

Eidson

[11] 4,345,755

[45] Aug. 24, 1982

[54] EXERCISING DEVICE

[76] Inventor: James A. Eidson, 4430 E. Sheila St., Los Angeles, Calif. 90023

[21] Appl. No.: 191,705

[22] Filed: Sep. 29, 1980

[51] Int. Cl.[3] ..... A63B 69/00; A63B 69/24

[52] U.S. Cl. ..... 272/78

[58] Field of Search ..... 273/55 R, 55 A; 272/77, 272/78, 76, 54, 111, 126, 70, 85, 87, 137, 61

[56] References Cited

U.S. PATENT DOCUMENTS 1,749,488 3/1930 King ..... 272/126

FOREIGN PATENT DOCUMENTS 1255733 1/1961 France ..... 272/85

265035 2/1927 United Kingdom ..... 273/55 R

*Primary Examiner*—Richard C. Pinkham
*Assistant Examiner*—T. Brown
*Attorney, Agent, or Firm*—Jack C. Munro

[57] ABSTRACT

A punching bag exercising device wherein two spaced-apart punching bags are connected to opposite ends of a single elongated member. The elongated member is to be swivelly supported with respect to a fixed supportive member. Each punching bag is to be swivelly mounted by a swivel hanger assembly with respect to the elongated member. An elastic cord is stretched between the hanger assemblies for each punching bag in order to damp undesirable lateral movements of the punching bags.

9 Claims, 3 Drawing Figures

10
12
14
16
18
20
22
24
26
28
30
32
34
36
38
40
41
42
43
44
46
48
50
52
54
56
58
30°
3
60
62
64
66
18'
20'
22'
24'
26'
28'
30'
32'
34'
36'
38'
40'
42'
44'
46'
48'
50'
52'
54'
56'
58'

EXERCISING DEVICE

BACKGROUND OF THE INVENTION

The field of this invention relates to a novel type of exercising device which is to be employed in conjunction with a pair of punching bags.

The use of a rather large size punching bag as an exercising device is well known. Frequently, such punching bags are utilized by individuals in order to build up strength by hand striking force of the individual. Typical usage of such large sized punching bags are for boxers and football players.

Conventional ways of employing a punching bag is to use a single punching bag and have it mounted from a ceiling or other appropriate supportive surface spaced a predetermined distance above the floor on which it is being employed. The procedure is for the individual to strike the punching bag which departs momentum to the bag which causes the bag to swing away from the striking area. When the bag returns to the striking area, the individual will strike the bag again and the procedure is repeated. Such punching bags have been known to come in different weights and may weigh as much as several hundred pounds.

However, prior to the present invention, there has not been known any device which expanded the usefulness of the punching bag. Previously, the punching bag was only for the purpose of building up strength. The subject invention is not only to be employed for the purpose of building up strength, but is also to be employed for the purpose of increasing coordination.

SUMMARY OF THE INVENTION

The structure of this invention relates to a single elongated member, each end of which is to include a swivel hanger assembly. Intermediate the ends thereof, a third swivel hanger assembly is mounted which is to be connected to a supportive surface, such as a ceiling. A separate punching bag is to be attached to each swivel assembly and is to be freely rotatable with respect to the elongated member. The elongated member is also to be freely rotatable with respect to the supportive surface. An elastic cord connects the swivel assemblies for the punching bags so as to damp undesirable lateral movement of the punching bags. The third swivel assembly will be evenly spaced from the ends of the elongated member when the punching bags are of the same weight. When the punching bags are of unequal weight, the third swivel assembly will be located nearer the end of the elongated member which supports the heavier punching bag.

The primary objective of this invention is to construct an exercising device which is not only to be employed to increase the strength of the user, but also to substantially increase the coordination of the user as the individual moves from one punching bag to the other and vice versa.

Another objective of this invention is to construct an exercising device which is composed of few parts and can be simply and inexpensively constructed.

DETAILED DESCRIPTION OF THE SHOWN EMBODIMENT

Figures 1, 2, 3:
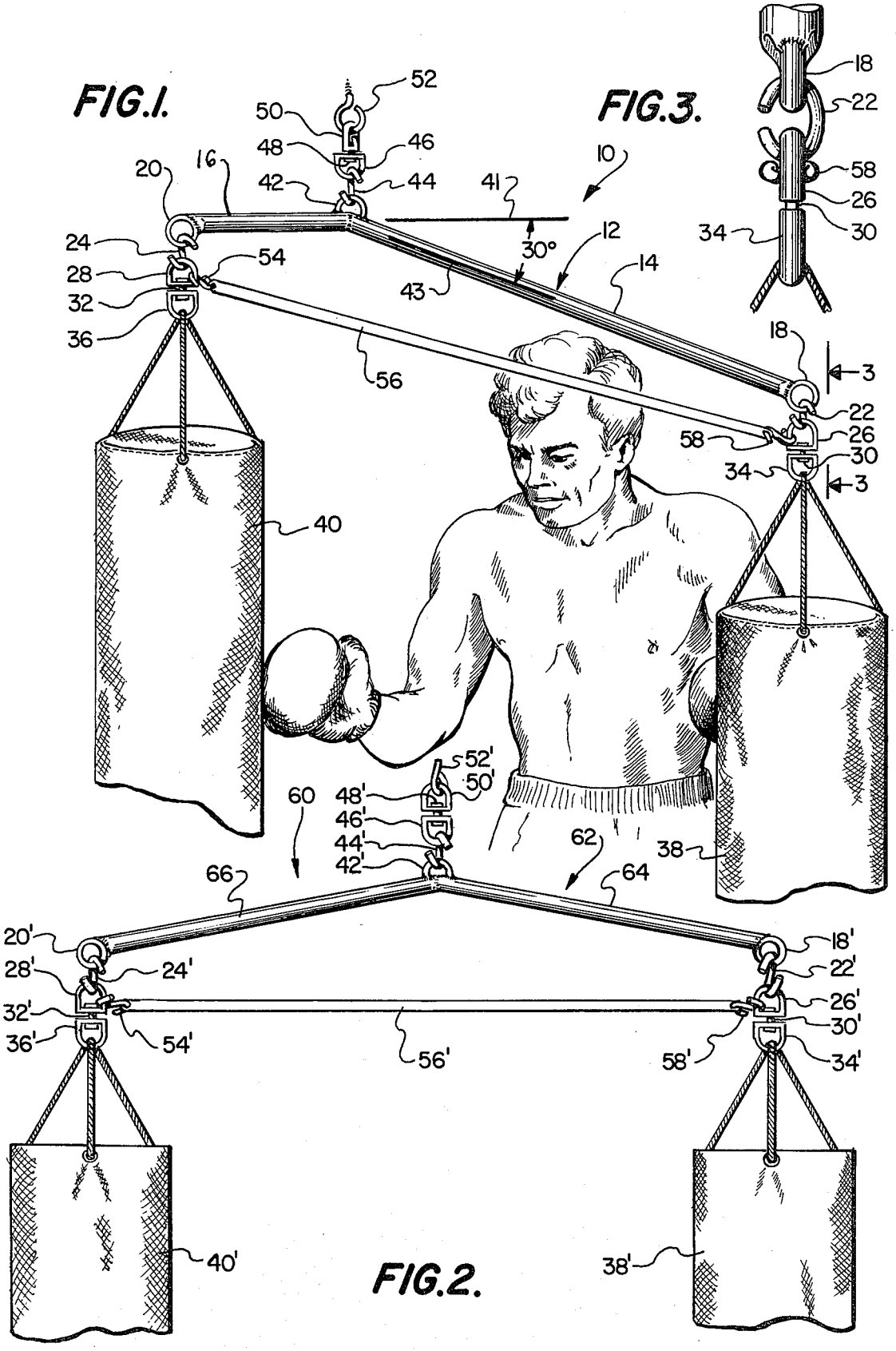
FIG. 1 is a front elevational view of the exercising device of this invention depicting typical use of the exercising device.
FIG. 2 is a view similar to FIG. 1, but of a modified form of exercising device of this invention.
FIG. 3 is an end view of the exercising device shown within FIG. 1 taken along line 3—3 of FIG. 1.

Referring particularly to the drawing, there is shown in FIG. 1, the exercising device 10 of this invention which is constructed primarily of an elongated member 12 which is in turn formed into portions 14 and 16. The member 12 can take any of numerous forms, such as metallic tubing. However, plate stock could be used.

Attached to the upper surface of the member 12 at the junction of the portions 14 and 16, is an eyelet 42. Connected to the eyelet 42 is a metallic hook member 44. The free end of the hook member 44 connects with an opening formed in U-shaped member 46. The U-shaped member 46 is connected to, in a back-to-back relationship, a second U-shaped member 50. The connection between the members 46 and 50 is by means of a pin 48. As a result, a free swiveling or rotational movement between the members 46 and 50 is achieved through the pin 48. Member 50 is to be connectable with a securing means, such as an eyelet 52, which in turn is to be secured to a supportive surface (not shown). A typical example of the supportive surface would be a ceiling or any type of sufficiently strong supportive surface which is spaced seven or eight feet above the floor (not shown).

The outer end of the portion 14 terminates in a short length tubular section 18. The outer end of the portion 16 also terminates in a similar tubular section 20. A hook member 22 connects with tubular section 18 and a similar hook member 24 connects with a tubular section 20. The hook member 22 also engages with a U-shaped member 26, while hook member 24 engages with U-shaped member 28. U-shaped member 26 connects through a pin 30 to a similar U-shaped member 34. U-shaped member 28 connects by means of a pin 32 to U-shaped member 36. It is to be understood that the just previously described U-shaped member and pin connections are identical to the previously described swivel connection defined by members 46, 48 and 50.

A punching bag 38 is to have appropriate lanyard means attached to its upper end thereof, which in turn is to engage with U-shaped member 34. In a similar manner, the punching bag 40 is to have appropriate lanyard means attached to its upper end which engages with the U-shaped member 36. As a result, it is to be readily seen that each of the punching bags 38 and 40 are supported with respect to the elongated member 12. It is also to be made apparent that each bag 30 and 40 is capable of rotational movement with respect to the member 12 due to the swivel connection between each of the punching bags and the elongated member 12.

The portion 16 is to have a longitudinal center axis 41. The portion 14 also has a longitudinal center axis 43. It is to be noted that the longitudinal center axis 43 is inclined at a thirty degree angle with respect to the longitudinal center axis 14. Also, it is to be noted that the distance from the longitudinal center of the punching bag 40 to the center axis of connection with the supportive member formed by eyelet 52 is ten inches. Bag 38 weighs ninety pounds and bag 40 weighs seventy pounds. The distance from the longitudinal center axis of the punching bag 38 to the point of connection of the eyelet 52 is to be twenty six and a half inches. It has been found that with this precise aforementioned arrangement employed, the at-rest position of the structure of this invention will be exactly as is shown in FIG. 1. The user is to be located in between and on one side of the bags 38 and 40, as is also shown within FIG. 1. As the user strikes the bag 38, the elongated member 12 is pivoted in respect to the U-shaped member 50. This pivoting motion causes the bag 40 to be moved toward the user. This requires the user to turn and strike the bag 40, which in turn stops the movement in this direction and reverses the movement causing the bag 38 to move toward the user. The harder the user strikes the bags 38 and 40, the quicker the movement of the opposite bag toward the user. The user can by controlling the striking force, predetermine the velocity at which the opposite bag will move toward the user. The user then is not only developing power in the striking force, but is also developing coordination.

Inherently, in the striking of each of the bags 38 and 40, they will each be pivoted relative to the elongated member 12 by means of a swivel assembly previously described. Also, each of the bags 38 and 40 will be caused to oscillate, or swing, laterally. This lateral movement of the bags 38 and 40 will occur normally, but is deemed to be undesirable. In order to minimize this lateral swinging movement, a motion damping device in the form of an elastic cord 56 is mounted between the U-shaped members 28 and 26. One end of the elastic cord 56 is connected to a hook 54 which engages with the U-shaped section 28. Similarly, the other end of the elastic cord 56 connects to a hook 58 which in turn engages with the U-shaped section 26. It has been found that the use of this elastic cord 56 is adequate for the minimizing of lateral movement of each of the bags 38 and 40. The lateral movement of each bag will have a tendency to cause its appropriate swivel assembly to also swing outwardly. This outward swinging movement is retarded through the use of the elastic cord 56. Connecting the cord 56 between the U-shaped members 26 and 28, the outward lateral movement of the bags 38 and 40 works against each other and not against a fixed member. This is also found to be more effective than working against a fixed member.

As previously mentioned, the particular arrangement shown within FIG. 1 is desirable when bag 38 weighs ninety pounds and bag 40 weighs seventy pounds. These are common weights for bags and that is why those weights have been selected. However, if different weight bags are employed, it is to be understood that the portion 16 could be extended (or shortened) and also the length of portion 14 could be extended (or shortened). Whatever the selected proportional length of the members of the portions 14 and 16, the eyelet 42 will be located at the junction of the portions 14 and 16.

Referring particularly to FIG. 2, there is shown a modified form 60 of the exercising device of this invention. Similar numerals have been employed to refer to like parts in relation to FIG. 1, and for a description of these parts, reference is to be had thereto.

Modified form 60 comprises an elongated member 62 which is divided into portions 64 and 66. At the junction of the portions 64 and 66, there is an eyelet 42' formed on the upper surface thereof. The hook member 44' connects with the eyelet 42'. The hook member 44' connects with the U-shaped member 46'. The U-shaped member 46' connects through a pin 48' to the U-shaped member 50'. The U-shaped member 50' connects to an eyelet 52', which in turn is secured to within a supportive surface (not shown).

The portions 64 terminates in a tubular member 18' which in turn is connected to a hook 22'. The hook 22' in turn attaches to a U-shaped member 26'. The U-shaped member 26' is swivelly connected by means of a pin 30' to a U-shaped section 34'. The punching bag 38' is connected by appropriate lanyard arrangement to the U-shaped member 34'.

The outer end of the portion 66 is formed into a tubular section 20'. A hook member 24' connects to tubular section 20' and the U-shaped section 28'. The U-shaped section 28' is connected through a pin 32' to a U-shaped section 36'. The bag 40' is connected by a lanyard arrangement to the U-shaped section 36'.

Lateral movement damping means, in the form of an elastic cord 56', is connected at one end thereof by means of a hook 54' to the U-shaped section 28'. The opposite end of the elastic cord 56' is connected through a hook 58' to the U-shaped section 26'.

In this modified form 60, the weight of the bags 38' and 40' will be identical. It is to be understood that the exercising device shown by the modified form 60 will be employed in precisely the same manner as the exercising device 10. However, the exercising device 10 has a further feature in that the weight of the bags 38 and 40 are different, which is an additional variable to which the user is subjected over and above that of the modified form 60.

What is claimed is:

1. An exercising device comprising:

a first punching bag and a second punching bag;

an elongated member having a first end and a second end, said first end being spaced from said second end, said elongated member having an upper surface and a lower surface;

a first hanger assembly connected to said first end on said lower surface, said first hanger assembly being connected to said first punching bag, said first hanger assembly including first swivel means for permitting three hundred and sixty degree rotation of said first punching bag relative to said elongated member;

a second hanger assembly connected to said second end on said lower surface, said second hanger assembly being connected to said second punching bag, said second hanger assembly including second swivel means for permitting three hundred and sixty degree rotation of said second punching bag relative to said elongated member; and a third hanger assembly connected to said elongated member on said upper surface, said third hanger assembly being located intermediate said first and second ends, said third hanger assembly being connected to a supportive member, said third hanger assembly including third swivel means for permitting swiveling of said elongated member relative to said supporting member.

2. The exercising device as defined in claim 1 including:

means for damping lateral movement of both said first and second punching bags.

3. The exercising device as defined in claim 2 wherein:

said means being connected between said first hanger assembly and said second hanger assembly.

4. An exercising device comprising:

first and second punching bags;

an elongated member having a first end and a second end, said first end being spaced from said second end, said elongated member having an upper surface and a lower surface;

a first hanger assembly connected to said first end on said lower surface, said first hanger assembly being connected to said first punching bag, said first hanger assembly including first swivel means for permitting rotation of said first punching bag relative to said elongated member;

a second hanger assembly connected to said second end on said lower surface, said second hanger assembly being connected to said second punching bag, said second hanger assembly including second swivel means for permitting rotation of said second punching bag relative to said elongated member; and a third hanger assembly connected to said elongated member on said upper surface, said third hanger assembly being located intermediate, said first and second ends, said third hanger assembly being connected to a supportive member, said third hanger assembly including third swivel means for permitting swiveling of said elongated member relative to said supporting member.

5. An exercising device comprising:

first and second punching bags;

an elongated member having a first end and a second end, said first end being spaced from said second end, said elongated member having an upper surface and a lower surface;

a first hanger assembly connected to said first end on said lower surface, said first hanger assembly being connected to said first punching bag, said first hanger assembly including first swivel means for permitting rotation of said first punching bag relative to said elongated member;

a second hanger assembly connected to said second end on said lower surface, said second hanger assembly being connected to said second punching bag, said second hanger assembly including second swivel means for permitting rotation of said second punching bag relative to said elongated member; and a third hanger assembly connected to said elongated member on said upper surface, said third hanger assembly being located intermediate said first and second ends, said third hanger assembly being connected to a supportive member, said third hanger assembly including third swivel means for permitting swiveling of said elongated member relative to said supporting member.

6. The exercising device as defined in claim 5 wherein:

the portion of said elongated member between said first end and said third hanger assembly having a first longitudinal center axis, the portion of said elongated member between said third hanger assembly and said second end having a second longitudinal center axis, said second longitudinal center axis being inclined at approximately thirty degrees with respect to said first longitudinal center axis.

7. The exercising device as defined in claim 6 wherein:

means for damping lateral movement of both said first and second punching bags.

8. The exercising device as defined in claim 7 wherein:

said means being connected between said first and second hangers.

9. The exercising device as defined in claim 8 wherein:

said means comprising a stretchable elastic cord.

* * * * *